US011910849B1

(12) United States Patent
Santiago Lugo

(10) Patent No.: US 11,910,849 B1
(45) Date of Patent: Feb. 27, 2024

(54) BABY VEST NECK SUPPORT DEVICE

(71) Applicant: Steven Santiago Lugo, Hilliard, OH (US)

(72) Inventor: Steven Santiago Lugo, Hilliard, OH (US)

( * ) Notice: Subject to any disclaimer, the term of this patent is extended or adjusted under 35 U.S.C. 154(b) by 253 days.

(21) Appl. No.: 17/151,597

(22) Filed: Jan. 18, 2021

Related U.S. Application Data

(60) Provisional application No. 62/963,108, filed on Jan. 19, 2020.

(51) Int. Cl.
*A41D 13/00* (2006.01)
*A47D 13/02* (2006.01)
*A45F 3/14* (2006.01)

(52) U.S. Cl.
CPC ..... *A41D 13/0007* (2013.01); *A45F 3/14* (2013.01); *A47D 13/02* (2013.01); *A41D 2600/00* (2013.01)

(58) Field of Classification Search
CPC ..... A61F 5/05883; A61F 5/055
See application file for complete search history.

(56) References Cited

U.S. PATENT DOCUMENTS 3,522,804 A * 8/1970 Towbin ..... A61F 5/055 2/415
4,708,129 A 11/1987 Pujals, Jr.
4,986,458 A * 1/1991 Linday ..... A47D 13/025 224/648
5,007,412 A 4/1991 Dewall
5,020,709 A * 6/1991 Hoaglan ..... A47D 13/025 224/625
5,242,377 A * 9/1993 Boughner ..... A61F 5/055 602/17
5,362,304 A 11/1994 Varn
(Continued)

FOREIGN PATENT DOCUMENTS

JP 10276869 A * 10/1998 ..... A47D 13/025
KR 20110003760 U * 4/2011 ..... A41B 13/065
WO WO-2019162389 A1 * 8/2019 ..... A47D 13/02

OTHER PUBLICATIONS

"Developmental milestones: head control", Baby Centre UK Website, Web page <https://www.babycentre.co.uk/a6579/developmental-milestones-head-control>, 8 pages, dated at least as early as Aug. 29, 2019, retrieved from www.babycentre.co.uk on Jan. 18, 2021.
(Continued)

*Primary Examiner* — Grace Huang
(74) *Attorney, Agent, or Firm* — The Law Office of Patrick F. O'Reilly, III, LLC

(57) ABSTRACT

A baby vest neck support device is disclosed herein. The baby vest neck support device includes a vest portion, the vest portion defining a head opening for accommodating a head of a baby, arm openings for accommodating arms of the baby, and a torso opening for accommodating a torso of the baby, and the vest portion including one or more straps for securing the vest portion to the baby; and a head and neck support portion coupled to the vest portion, the head and neck support portion including an inner support layer configured to be partially received within a pocket of the vest portion, and the head and neck support portion further including an outer padded layer disposed over an upper head section of the inner support layer.

13 Claims, 10 Drawing Sheets

(56) References Cited

U.S. PATENT DOCUMENTS

| | | | | |
|---|---|---|---|---|
| 5,546,620 | A * | 8/1996 | Matthews | A47D 13/08 5/639 |
| 6,254,560 | B1 | 7/2001 | Tweardy et al. | |
| 6,267,741 | B1 * | 7/2001 | Lerman | A61F 5/055 602/18 |
| 6,447,353 | B1 | 9/2002 | Henry | |
| 7,197,781 | B2 | 4/2007 | Ramsbottom et al. | |
| 8,424,732 | B1 * | 4/2013 | Lehan | A47D 13/025 224/159 |
| 9,021,636 | B2 | 5/2015 | Schwingendorf et al. | |
| 9,066,608 | B2 * | 6/2015 | Park | A47D 13/02 |
| 9,113,722 | B1 | 8/2015 | Jeno | |
| 9,237,771 | B2 * | 1/2016 | Paperno | A41B 13/065 |
| 9,357,852 | B2 * | 6/2016 | Salazar | A47D 13/025 |
| 9,579,230 | B1 | 2/2017 | Alsaffar | |
| 10,722,048 | B2 * | 7/2020 | Peterson | A47D 13/08 |
| 10,791,774 | B2 * | 10/2020 | Plant | A41D 27/205 |
| 2004/0149790 | A1 * | 8/2004 | Kassai | A47D 13/02 224/160 |
| 2005/0279785 | A1 | 12/2005 | Liistro et al. | |
| 2006/0261104 | A1 * | 11/2006 | Zambrzycki | A47D 13/025 224/160 |
| 2008/0283559 | A1 * | 11/2008 | Parness | A47D 13/025 224/159 |
| 2009/0138064 | A1 | 5/2009 | Horn | |
| 2010/0072236 | A1 * | 3/2010 | Parness | A47D 13/025 224/160 |
| 2010/0155446 | A1 | 6/2010 | Gilbert | |
| 2011/0043025 | A1 | 2/2011 | Park | |
| 2011/0197365 | A1 | 8/2011 | Wadia | |
| 2012/0266350 | A1 * | 10/2012 | Zack | A47D 13/025 2/84 |
| 2014/0066828 | A1 | 3/2014 | Sookdeo | |
| 2021/0030076 | A1 * | 2/2021 | Lee | A41B 13/065 |

OTHER PUBLICATIONS

"What Are the Injuries When an Infant's Head Isn't Supported?", Hello Motherhood Website, Web page <https://www.hellomotherhood.com/what-are-the-injuries-when-an-infants-head-isnt-supported-4378423.html>, 5 pages, dated Dec. 18, 2018, retrieved from www.hellomotherhood.com on Jan. 18, 2021.

"Studies Implicate Early Injury to Cerebellum as Major Cause of Autism", RSS Website, Web page <https://neuron155.rssing.com/chan-30430181/all_p1.html>, 15 pages, dated Sep. 9, 2014, retrieved from www.rssing.com on Jan. 18, 2021.

"Definition of Cerebral Palsy", CerebralPalsy.org Website, Web page <https://www.cerebralpalsy.org/about-cerebral-palsy/definition>, 9 pages, dated at least as early as Aug. 29, 2019, retrieved from www.cerebralpalsy.org on Jan. 18, 2021.

"Cerebral Palsy: Hope Through Research", National Institute of Neurological Disorders and Stroke Website, Web page <https://www.ninds.nih.gov/Disorders/Patient-Caregiver-Education/Hope-Through-Research/Cerebral-Palsy-Hope-Through-Research>, 20 pages, dated at least as early as Aug. 29, 2019, retrieved from www.ninds.nih.gov on Jan. 18, 2021.

"Baby Bjorn Baby Carrier Original—Dark Blue, Cotton", Walmart Website, Web page <https://www.walmart.com/ip/BabyBjorn-Baby-Carrier-Original-Dark-Blue-Cotton/34480040>, 6 pages, dated at least as early as Oct. 8, 2015, retrieved from walmart.com website on Jan. 5, 2023.

"Boppy Organic Head Neck & Support, Let's Go Grey", MacroBaby Website, Web page <https://www.macrobaby.com/products/boppy-organic-head-neck-support-lets-go-grey?variant=39714500804667&currency=USD&utm_medium=product_sync&utm_source=google&utm_content=sag_organic&utm_campaign=sag_organic>, 4 pages, product dated at least as early as Aug. 24, 2018, retrieved from macrobaby.com website on Jan. 5, 2023.

"Head Protection Pad, Adjustable Safety Pad for Walker Protection Head Suitable Age 4-24 Months (Moonlight white)". Walmart Website, Web page <https://www.walmart.com/ip/Head-Protection-Pad-Adjustable-Safety-Pad-for-Walker-Protection-Head-Suitable-Age-4-24-Months-Moonlight-white/1672510078?wmlspartner=wlpa&selectedSellerId=101191125>, 3 pages, product dated at least as early as Aug. 24, 2018, retrieved from walmart.com website on Jan. 5, 2023.

"JJ Cole Head Support—Khaki", Albeebaby Website, Web page <https://www.albeebaby.com/jj-cole-head-support-khaki.html>, 5 pages, dated at least as early as Mar. 13, 2012, retrieved from walmart.com website on Jan. 5, 2023.

* cited by examiner

Detail "A"

BABY VEST NECK SUPPORT DEVICE

CROSS-REFERENCE TO RELATED APPLICATIONS

This patent application claims priority to, and incorporates by reference in its entirety, U.S. Provisional Patent Application No. 62/963,108, entitled "Baby Vest Neck Support Device", filed on Jan. 19, 2020.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a baby vest neck support device. More particularly, the invention relates to a baby vest neck support device that provides support for the neck, head, cervical spine, and spinal cord of a newborn baby.

2. Background

In the case of a newborn, the neck is extremely weak at birth and the need of head and neck support is crucial to avoid injuries. Neck and head support is important until the neck muscles get stronger. Gaining neck muscle strength is crucial for the baby's movement and development, such as crawling, walking, sitting up, and rolling over (see ref. 1). Parents should always provide neck and head support to newborns under one month. Newborns older than two months should continue getting head and neck support until they have gained head control (see ref. 1). By their sixth month, the baby's neck muscles should be strong enough to support his or her own head (see ref. 2).

Not supporting a newborn's head can cause serious injuries to the baby's spinal cord, spine, neck, and head that could affect his or her lifestyle. Brain damage could be a consequence of not supporting a newborn's head. This is caused when a baby experiences acute head trauma or "shaking baby syndrome". Blood vessels, nerves, and tissues are damaged as a result of the baby's brain moving back and forth, causing developmental problems such as impaired speech, learning disabilities, memory problems, and mental retardation. Neurological problems such as seizure disorder and impaired motor and sensory skills can also occur (see ref. 2). Also, studies suggest that injuries to the brain can lead to the development of Autism (see ref. 3).

Similar to newborn babies, many individuals with cerebral palsy do not have head and neck control. In the case of cerebral palsy, this condition has many different effects on one's body. Some of these effects include changes to muscle control and coordination, muscle tone, reflex and posture, balance, and body movement. Cerebral palsy can be caused by brain damage due to injury, or irregular development of the brain before, during, or shortly after birth (see ref. 4). Some children have acquired cerebral palsy after they are born as a result of brain damage in the first few months or year of life, caused by head injury and other traumas (see ref. 5). Cases of cerebral palsy caused by genetic abnormalities cannot be prevented; however acquired cerebral palsy produced by head injuries can be prevented (see ref. 5).

Therefore, what is needed is a baby vest neck support device that provides support for a neck, head, spine, and spinal cord, and thus helps to eliminate injuries to a baby's neck, head, spine, and spinal cord. Moreover, a baby vest neck support device is needed that prevents a newborn baby's neck from falling backward, therefore avoiding neck injuries and brain damage to the infant. Furthermore, there is a need for a vest neck support device that provides head and neck support to people with cerebral palsy that do not have head and neck control.

BRIEF SUMMARY OF EMBODIMENTS OF THE INVENTION

Accordingly, the present invention is directed to a baby vest neck support device that substantially obviates one or more problems resulting from the limitations and deficiencies of the related art.

In accordance with one or more embodiments of the present invention, there is provided a baby vest neck support device that includes a vest portion, the vest portion defining a head opening for accommodating a head of a baby, arm openings for accommodating arms of the baby, and a torso opening for accommodating a torso of the baby, and the vest portion including one or more straps for securing the vest portion to the baby; and a head and neck support portion coupled to the vest portion, the head and neck support portion including an inner support layer configured to be partially received within a pocket of the vest portion, and the head and neck support portion further including an outer padded layer disposed over an upper head section of the inner support layer.

In a further embodiment of the present invention, the one or more straps of the vest portion comprise at least one torso strap configured to be disposed around the torso of the baby and a crotch strap configured to be disposed in the crotch area of the baby.

In yet a further embodiment, the upper head section of the head and neck support portion is in the form of a hood, and the hood of the head and neck support portion comprises at least one plurality of attachment devices for attaching an accessory to the hood of the head and neck support portion.

In still a further embodiment, the at least one plurality of attachment devices of the hood of the head and neck support portion comprises a first plurality of the attachment portions on an interior of the hood of the head and neck support portion for attaching an interior accessory to the hood, and a second plurality of the attachment portions on an exterior of the hood of the head and neck support portion for attaching an exterior accessory to the hood.

In yet a further embodiment, the interior accessory to the hood comprises a pillow, and the exterior accessory to the hood is selected from the group consisting of a head stabilizer accessory, a hanging toy ring, a blanket, and combinations thereof.

In still a further embodiment, the inner support layer of the head and neck support portion is removable from the pocket of the vest portion, the pocket of the vest portion including a pocket opening with a closure mechanism disposed transversely across a rear surface of the vest portion.

In yet a further embodiment, the closure mechanism of the pocket of the vest portion comprises a zipper closure mechanism.

In still a further embodiment, the inner support layer of the head and neck support portion comprises a lower torso portion that is configured to be removably disposed in the pocket of the vest portion, and the upper head section of the inner support layer is configured to be disposed outside of the pocket of the vest portion.

In yet a further embodiment, the vest portion comprises one or more first apertures disposed in a rear surface of the vest portion, the inner support layer of the head and neck support portion comprises one or more second apertures disposed in a rear surface of the inner support layer, and the one or more first apertures of the vest portion corresponding to the one or more second apertures of the inner support layer so as to receive one or more securement straps for removably attaching the inner support layer to the vest portion.

In still a further embodiment, the baby vest neck support device further comprises a backpack-type harness for attaching the baby vest neck support device to a torso of a person, the backpack-type harness configured to be attached to the baby vest neck support device by means of a connecting strap passing through the one or more first apertures of the vest portion and the one or more second apertures of the inner support layer.

In accordance with one or more other embodiments of the present invention, there is provided a baby vest neck support device that includes a vest portion, the vest portion defining a head opening for accommodating a head of a baby, arm openings for accommodating arms of the baby, and a torso opening for accommodating a torso of the baby, and the vest portion including one or more straps for securing the vest portion to the baby; and a head and neck support portion coupled to the vest portion, the head and neck support portion including an inner support layer configured to be partially received within a pocket of the vest portion, the head and neck support portion further including an outer padded layer disposed over an upper head section of the inner support layer, the upper head section of the head and neck support portion being in the form of a hood, and the hood of the head and neck support portion including at least one plurality of attachment devices for attaching an accessory to the hood of the head and neck support portion.

In a further embodiment of the present invention, the one or more straps of the vest portion comprise at least one torso strap configured to be disposed around the torso of the baby and a crotch strap configured to be disposed in the crotch area of the baby.

In yet a further embodiment, the at least one plurality of attachment devices of the hood of the head and neck support portion comprises a first plurality of the attachment portions on an interior of the hood of the head and neck support portion for attaching an interior accessory to the hood, and a second plurality of the attachment portions on an exterior of the hood of the head and neck support portion for attaching an exterior accessory to the hood.

In still a further embodiment, the interior accessory to the hood comprises a pillow, and the exterior accessory to the hood is selected from the group consisting of a head stabilizer accessory, a hanging toy ring, a blanket, and combinations thereof.

In yet a further embodiment, the inner support layer of the head and neck support portion is removable from the pocket of the vest portion, the pocket of the vest portion including a pocket opening with a closure mechanism disposed transversely across a rear surface of the vest portion.

In still a further embodiment, the closure mechanism of the pocket of the vest portion comprises a zipper closure mechanism.

In yet a further embodiment, the inner support layer of the head and neck support portion comprises a lower torso portion that is configured to be removably disposed in the pocket of the vest portion, and the upper head section of the inner support layer is configured to be disposed outside of the pocket of the vest portion.

In still a further embodiment, the vest portion comprises one or more first apertures disposed in a rear surface of the vest portion, the inner support layer of the head and neck support portion comprises one or more second apertures disposed in a rear surface of the inner support layer, and the one or more first apertures of the vest portion corresponding to the one or more second apertures of the inner support layer so as to receive one or more securement straps for removably attaching the inner support layer to the vest portion.

In yet a further embodiment, the baby vest neck support device further comprises a backpack-type harness for attaching the baby vest neck support device to a torso of a person, the backpack-type harness configured to be attached to the baby vest neck support device by means of a connecting strap passing through the one or more first apertures of the vest portion and the one or more second apertures of the inner support layer.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 8:
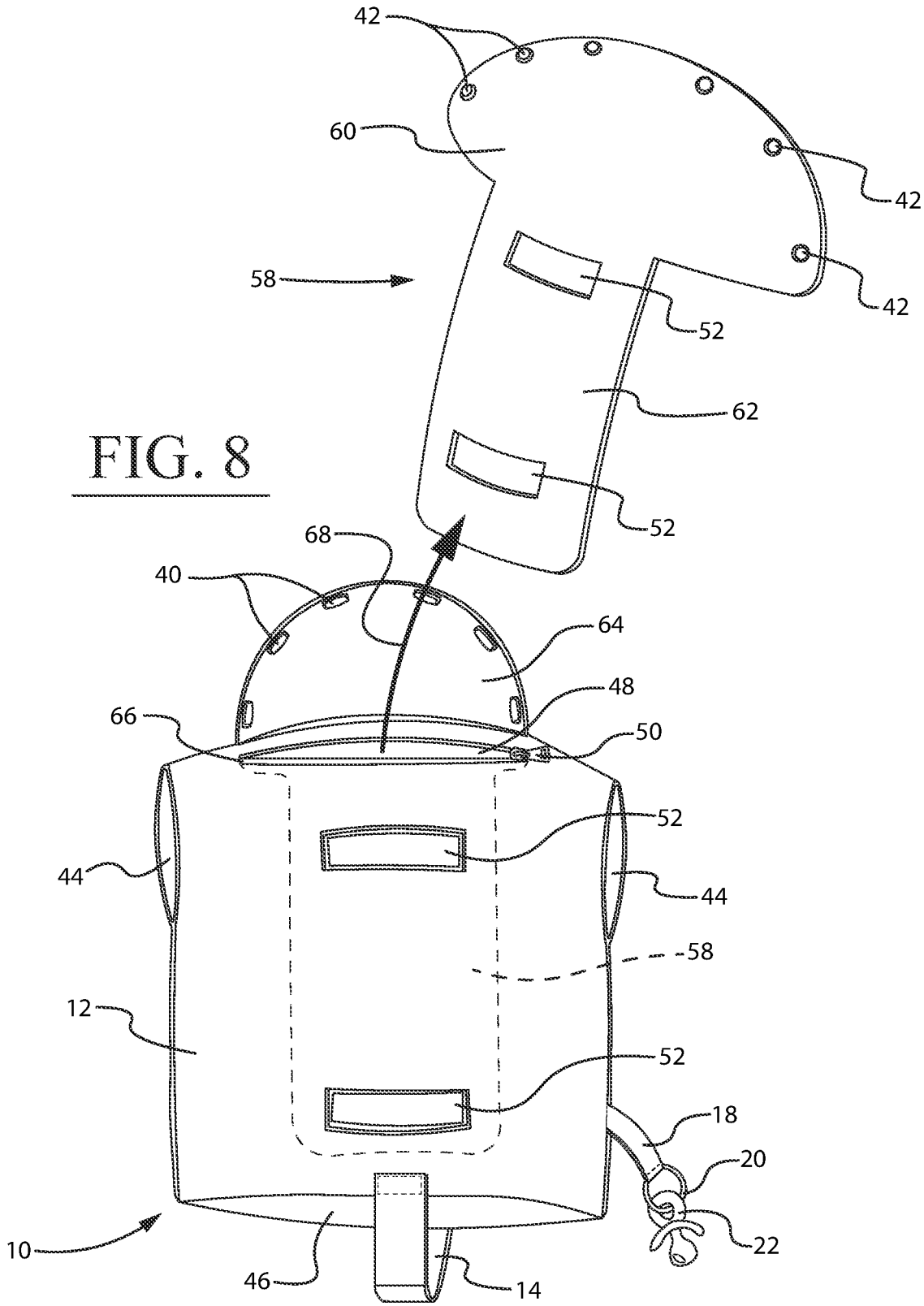
FIG. 8 is a rear perspective view depicting the removal of the inner support layer from the remainder of the baby vest neck support device of FIG. 1.
Figure 10:
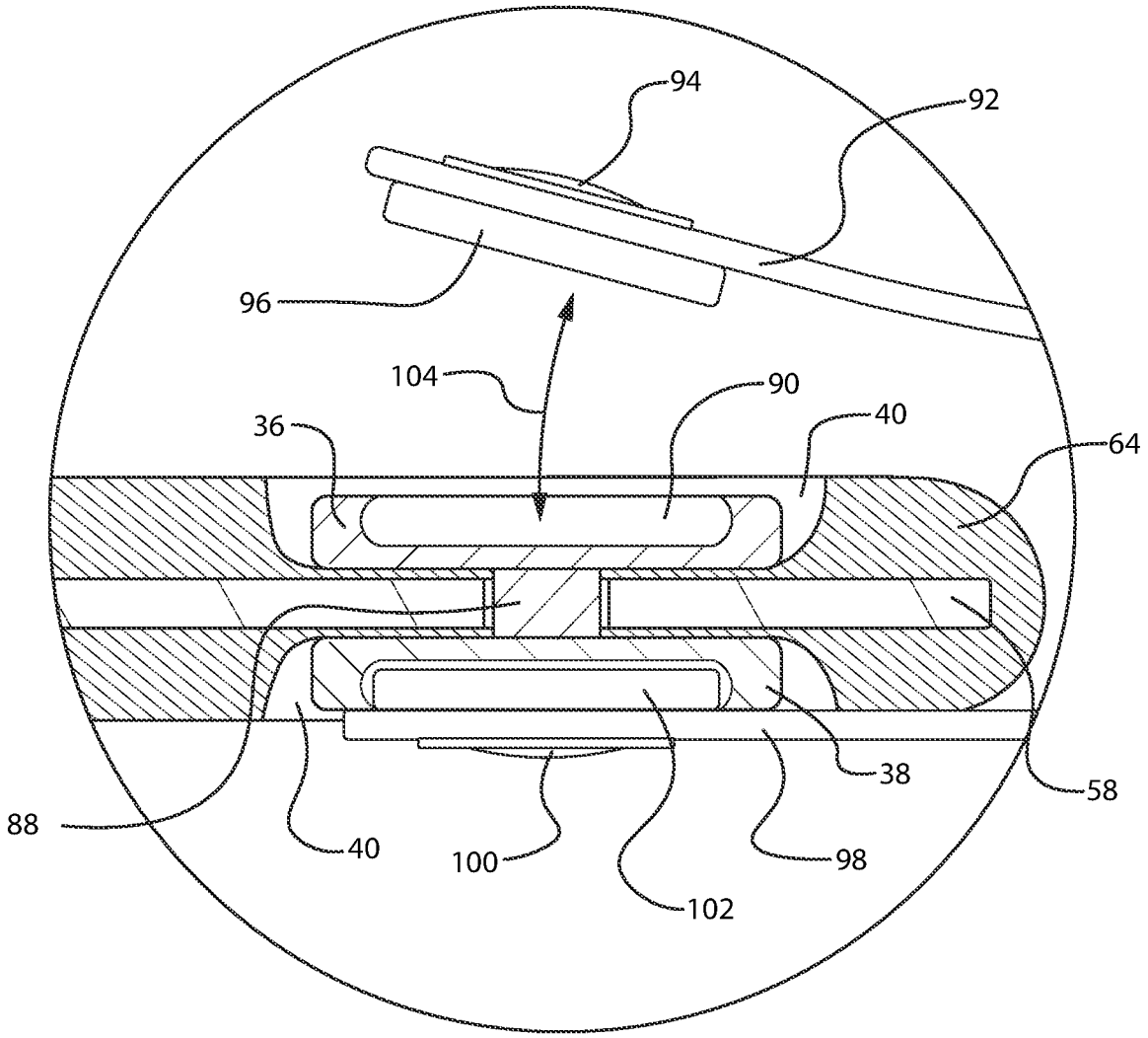
FIG. 10 is an enlarged sectional view illustrating the attachment of accessories to the hood of the baby vest neck support device illustrated in FIG. 3 (Detail "A")

An illustrative embodiment of a baby vest neck support device is seen generally at 10 in FIGS. 1-8. With initial reference to FIGS. 1, 2, 7, 8, and 10, it can be seen that the baby vest neck support device 10 generally comprises a vest portion 12, the vest portion 12 defining a head opening 56 (see FIG. 7) for accommodating a head of a baby 110, arm openings 44 for accommodating arms of the baby 110, and a torso opening 46 for accommodating a torso of the baby 110 (see FIG. 2), and the vest portion 12 including a plurality of straps 14, 24, 26 for securing the vest portion 12 to the baby 110; and a head and neck support portion 34 coupled to the vest portion 12, the head and neck support portion 34 including an inner support layer 58 configured to be partially received within a pocket of the vest portion 12 (see FIG. 8), and the head and neck support portion 34 further including an outer padded fabric layer 64 disposed over an upper head section 60 of the inner support layer 58 (see FIGS. 8 and 10). As shown in FIGS. 8 and 10, the upper head section 60 of the inner support layer 58 and the outer padded fabric layer 64 together form an upper head support 35 of the head and neck support portion 34. In the illustrative embodiment, the baby vest neck support device 10 is particularly configured to constrain the movement of a newborn baby's head while a person is holding the baby in one's arms using a harness-style vest portion 12 with the head and neck support portion 34. The inner support layer 58 of the head and neck support portion 34 of the device 10 functions as a semi-rigid "spine" member or shell member in the back of the device 10 so as to provide neck and head support for the newborn baby. The inner support layer 58 also extends down to the lower back to provide vertebral spine support.

Figure 1:
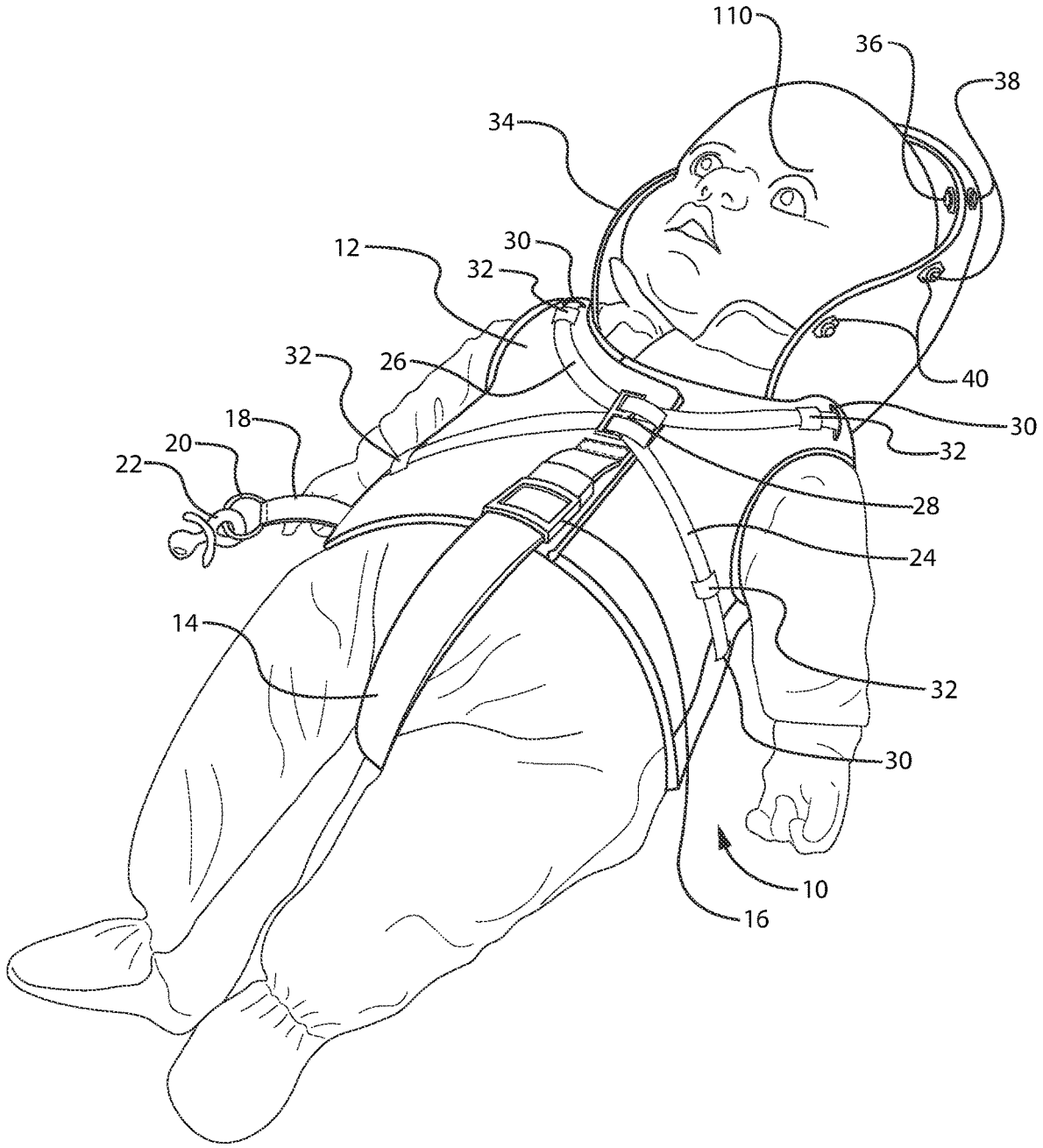
FIG. 1 is a perspective view of a baby vest neck support device disposed on a baby, according to an illustrative embodiment of the invention.
Figure 2:
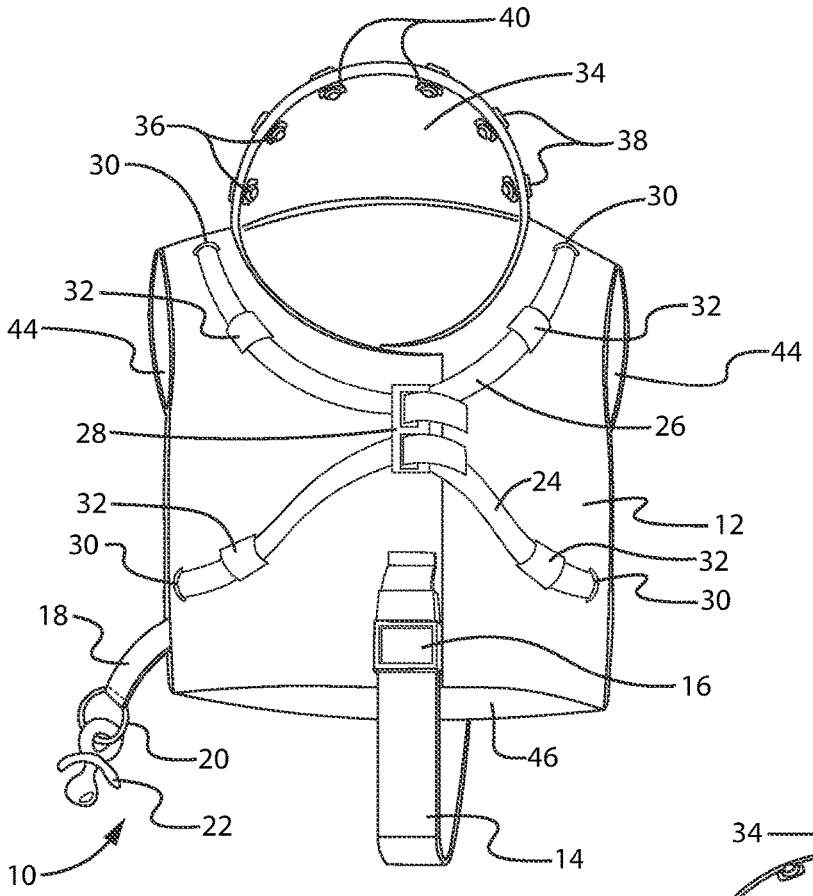
FIG. 2 is a front elevational view of the baby vest neck support device of FIG. 1.

In the illustrated embodiment, with combined reference to FIGS. 1 and 2, it can be seen that the plurality of straps 14, 24, 26 of the vest portion 12 comprise first and second torso straps 24, 26 configured to be disposed around the torso of the baby 110 and a crotch strap 14 configured to be disposed in the crotch area of the baby 110. In the illustrative embodiment, the first and second torso straps 24, 26 operate as tensioning straps so that the vest portion 12 is disposed tight on the baby 110, thus giving the baby 110 a secure feeling while wearing the device 10. In the illustrative embodiment, the first and second torso straps 24, 26 may be tightened around the baby 110 by using a common strap buckle 28 disposed in the front of the baby 110. As shown in FIGS. 1 and 2, the straps 24, 26 may be attached to the front of the vest portion 12 by strap loops 32, and the straps 24, 26 may pass through apertures 30 in the side of the vest portion 12 and be routed internally within the vest portion 12 so as to be hidden from view in the rear of the vest portion 12. Also, in the illustrative embodiment of FIGS. 1 and 2, the crotch strap 14 is secured around the crotch area of the baby 110 by a strap buckle 16 so as to prevent the vest portion 12 of the device 10 from sliding up too far on the baby 110.

In the illustrative embodiment, the crotch strap 14 and the first and second torso straps 24, 26 of the vest portion 12 may be in the form of nylon straps, and their respective strap buckles 16, 28 may be formed from a polymeric material or plastic.

Referring again to the illustrative embodiment of FIGS. 1 and 2, it can be seen that the baby vest neck support device 10 may further include a stretchable accessory strap 18 disposed on one side of the vest portion 12. As shown in these figures, the stretchable accessory strap 18 may further include an accessory ring 20 attached to a free end thereof for accommodating an accessory, such as a pacifier 22. The accessory ring 20 may be used to accommodate a wide variety of different accessories, such as various toys.

In the illustrative embodiment, the vest portion 12 of the baby vest neck support device 10 may be formed from an air permeable material (e.g., a breathable fabric material) so that the baby 110 does not get overly hot while wearing the device 10. For example, the vest portion 12 may be formed from a breathable organic material, such as bamboo.

Figure 11:
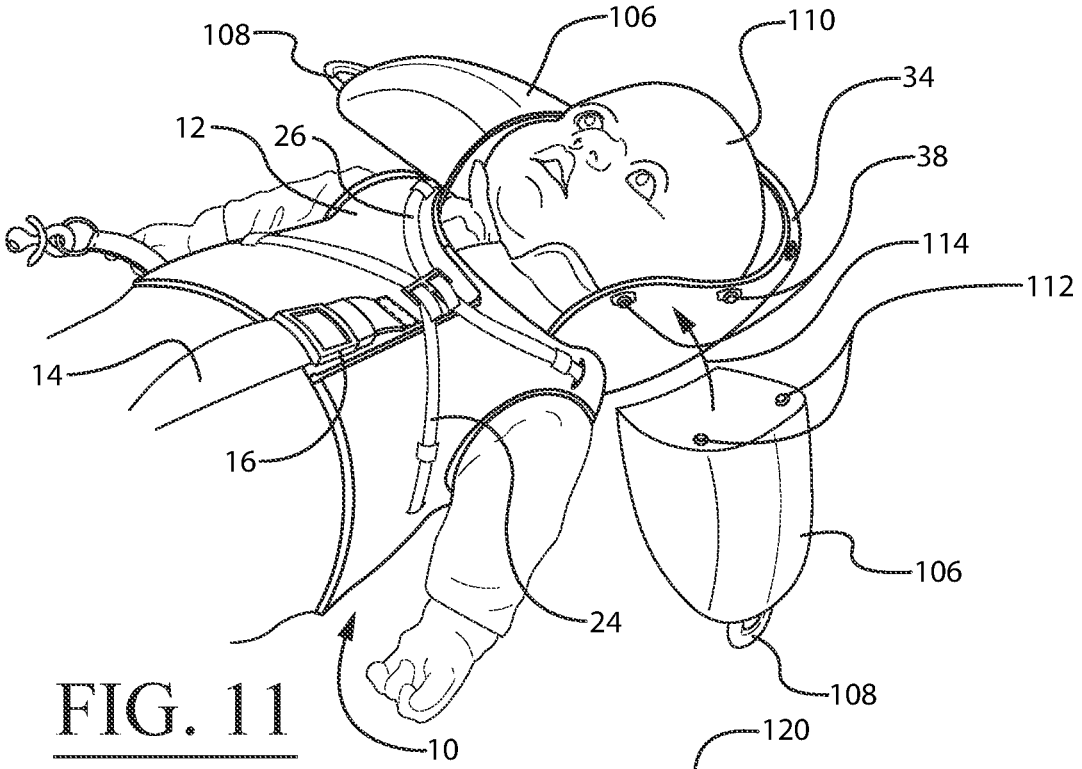
FIG. 11 is a perspective view illustrating the attachment of a head stabilizer accessory to the exterior of the hood of the baby vest neck support device of FIG. 1.
Figure 13:
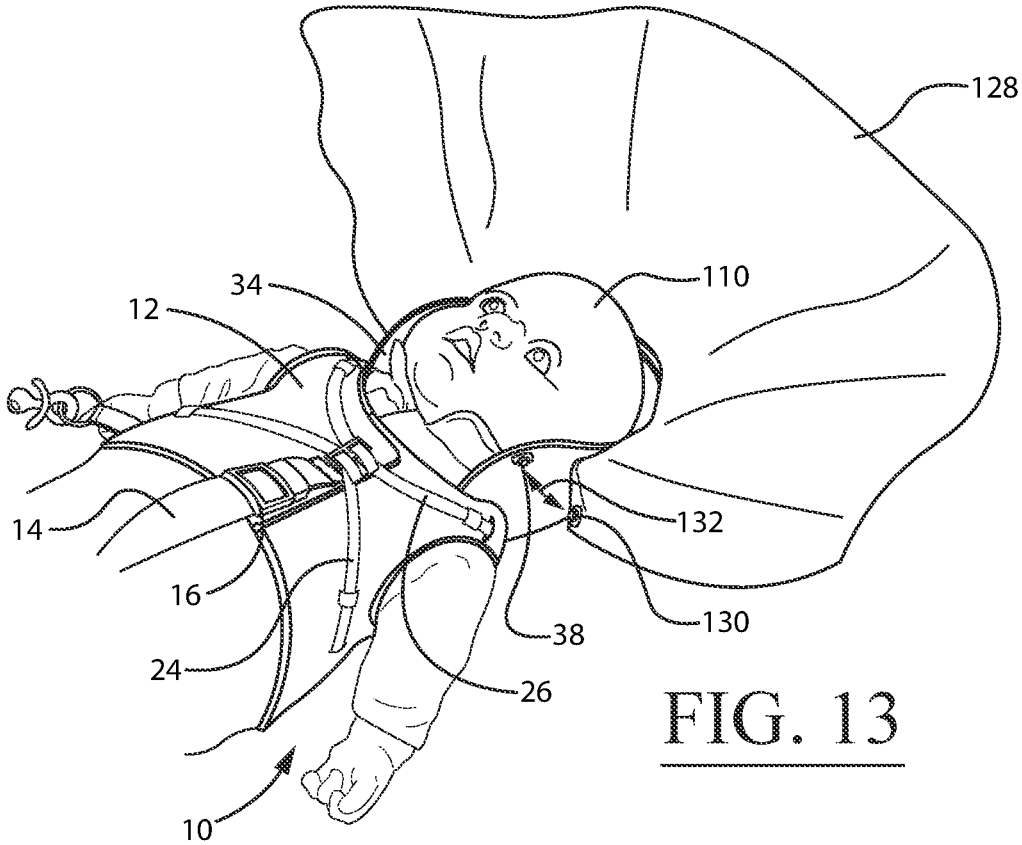
FIG. 13 is a perspective view illustrating the attachment of a blanket accessory to the exterior of the hood of the baby vest neck support device of FIG. 1.
Figure 14:
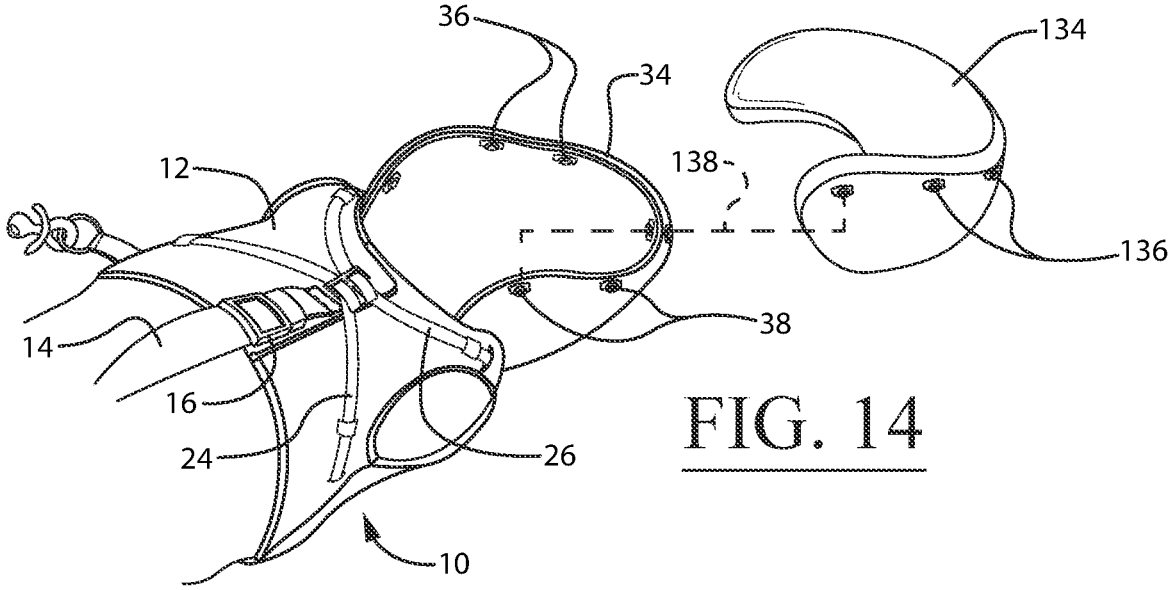
FIG. 14 is a perspective view illustrating the attachment of a pillow accessory to the interior of the hood of the baby vest neck support device of FIG. 1.

Turning again to FIGS. 1, 2, 8, and 10, the head and neck support portion 34 of the baby vest neck support device 10 will be described in further detail. In the illustrative embodiment, the upper head section of the head and neck support portion 34 is in the form of a hood (see FIGS. 1 and 2), and the hood of the head and neck support portion 34 comprises first and second pluralities of attachment devices 36, 38 for attaching an accessory 106, 116, 128, 134 to the hood of the head and neck support portion 34 (refer to FIGS. 11-14). In the illustrative embodiment, the first and second pluralities of attachment devices 36, 38 comprise a first plurality of the attachment portions 36 on an interior of the hood of the head and neck support portion 34 (see FIGS. 1 and 2) for attaching an interior accessory to the hood, and a second plurality of the attachment portions 38 on an exterior of the hood of the head and neck support portion 34 (see FIGS. 1 and 2) for attaching an exterior accessory to the hood. For example, as shown in FIG. 14, the interior accessory attached to the hood of the head and neck support portion 34 using the attachment portions 36 may comprise a pillow 134. In the illustrative embodiment, the pillow 134 may be any type of suitable pillow, such as a pillow formed from a material that adjusts to the baby's head (e.g., a memory foam pillow). As another example, as shown in FIG. 11, the exterior accessory attached to the hood of the head and neck support portion 34 using the attachment portions 38 may comprise a head stabilizer accessory 106 for preventing the rolling of the head of the baby 110 (e.g., to prevent sudden infant death syndrome (SIDS) while the baby 110 is sleeping). As yet another example, as shown in FIG. 13, the exterior accessory attached to the hood of the head and neck support portion 34 using the attachment portions 38 may comprise a breastfeeding blanket accessory 128 for providing privacy while the mother is breastfeeding her baby.

Figure 12:
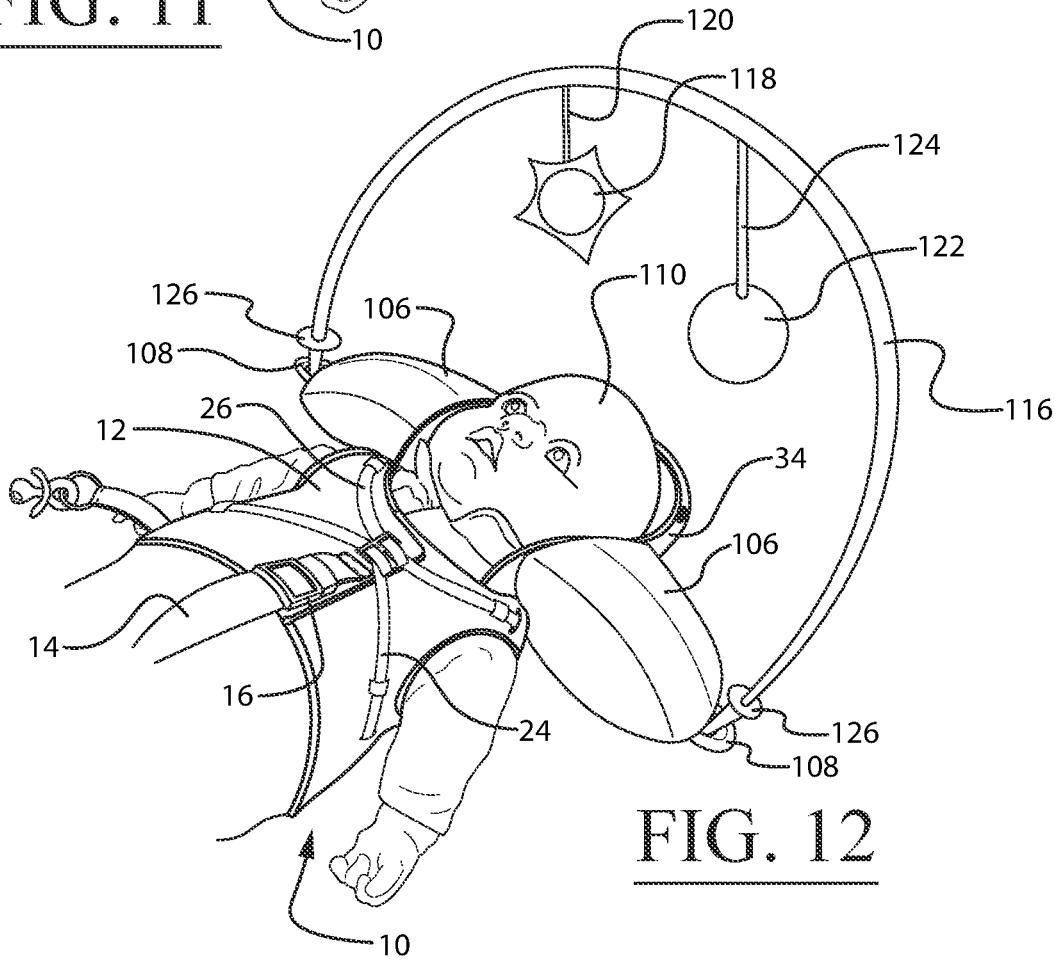
FIG. 12 is a perspective view illustrating a hanging toy ring that may be used with the head stabilizer accessory that is attached to the exterior of the hood of the baby vest neck support device of FIG. 1.

With combined reference to FIGS. 11 and 12, it can be seen that each of the head stabilizers 106 may comprise ring members 108 on the outer ends thereof so as to provide mounting means for other accessories, such as the hanging toy ring 116 depicted in FIG. 12. In FIG. 12, it can be seen that the oppositely disposed ends of the hanging toy ring 116 are provided with end connector members 126 that engage with the respective ring members 108 of the head stabilizers 106 (e.g., each of the end connector members 126 may be in the form of a plastic plug that snaps into its respective ring member 108). As shown in FIG. 12, a plurality of toys 118, 122 may be mounted in a suspended or hanging manner from the toy ring 116. More specifically, the first toy 118 may be hung from the toy ring 116 by a first connector rod 120, and the second toy 122 may be hung from the toy ring 116 by a second connector rod 124.

As shown in FIGS. 1, 2, and 10-14, in the illustrative embodiment, the first and second pluralities of attachment devices 36, 38 are in the form of snap button portions so that the accessories 106, 116, 128, 134 are able to be snapped into place onto the hood of the head and neck support portion 34. The structure of the snap button portions 36, 38 of the illustrative embodiment will be more specifically described with reference to the enlarged sectional view of FIG. 10. As shown in this figure, each interior snap button portion 36 is attached to each exterior snap button portion 38 by means of a connecting stem portion 88. The connecting stem portion 88 passes through an aperture 42 (see FIG. 8) in the inner support layer 58 of the head and neck support portion 34. Also, in FIG. 10, it can be seen that each snap button portion 36, 38 is disposed within a recess 40 formed in the outer padded layer 64 that covers the inner support layer 58. Referring again to FIG. 10, it can be seen that the interior snap button portion 36 is configured to engage with a corresponding snap button portion 96 on an inner fabric head cover 92 so as to attach the inner fabric head cover 92 to the interior of the hood of the head and neck support portion 34 (the engagement between the snap button portions 36, 96 is diagrammatically represented by the curved arrow 104 in FIG. 10). The snap button portion 96 with button head 94 fits into the recess 90 of the interior snap button portion 36 on the hood (see FIG. 10). In FIG. 10, it further can be seen that the exterior snap button portion 38 is configured to engage with a corresponding snap button portion 102 on an outer fabric head cover 98 so as to attach the outer fabric head cover 98 to the exterior of the hood of the head and neck support portion 34. Similar to the snap button portion 96 of the inner fabric head cover 92, the snap button portion 102 with button head 100 fits into the recess of the exterior snap button portion 38 on the hood (see FIG. 10).

In the illustrative embodiment, referring again to FIG. 11, the end of the head stabilizer accessory 106 opposite to the ring member 108 is provided with a pair of snap button portions 112 that engage with a pair of respective exterior snap button portions 38 on the hood of the head and neck support portion 34 such that the head stabilizer accessory 106 snaps into place on the exterior of the hood (the attachment of the head stabilizer accessory 106 to the hood is diagrammatically represented by the curved arrow 114 in FIG. 11). Turning again to FIG. 13, in the illustrative embodiment, the inner periphery of the breastfeeding blanket accessory 128 is provided with a plurality of snap button portions 130 that engage with respective exterior snap button portions 38 on the hood of the head and neck support portion 34 such that the breastfeeding blanket accessory 128 snaps into place on the exterior of the hood (the attachment of the breastfeeding blanket accessory 128 to the hood is diagrammatically represented by the curved arrow 132 in FIG. 13). Referring again to FIG. 14, in the illustrative embodiment, the outer periphery of the pillow accessory 134 is provided with a plurality of snap button portions 136 that engage with respective interior snap button portions 36 on the hood of the head and neck support portion 34 such that the pillow accessory 134 snaps into place on the interior of the hood (the attachment of the pillow accessory 134 to the hood is diagrammatically represented by the dashed line 138 in FIG. 14).

While the attachment devices for the accessories 106, 116, 128, 134 comprise snap buttons in the illustrative embodiment, it is to be understood that various types of suitable attachment devices may be used for attaching the accessories 106, 116, 128, 134. For example, in one or more alternative embodiments, a hook-and-loop fastener device (e.g., Velcro®) may be used to attach the accessories 106, 116, 128, 134 to the hood of the head and neck support portion 34.

With reference again to FIG. 8, further details of the illustrative head and neck support portion 34 of the baby vest neck support device 10 will be described. In FIG. 8, it can be seen that the inner support layer 58 of the head and neck support portion 34 is removable from the pocket of the vest portion 12 (as diagrammatically represented by the curved arrow 68 in FIG. 8). As shown in FIG. 8, the pocket of the vest portion 12 includes a pocket opening 48 with a closure mechanism 50 disposed transversely across a rear surface of the vest portion 12. In the illustrative embodiment, the closure mechanism of the pocket of the vest portion 12 comprises a zipper closure mechanism 50 and the perimeter rim 66 of the pocket opening 48 comprises zipper tracks. Also, in FIG. 8, it can be seen that the inner support layer 58 of the head and neck support portion 34 comprises an upper head section 60 and a lower torso portion 62. Together, the upper head section 60 and the lower torso portion 62 form a generally T-shaped inner support layer 58. The lower torso portion 62 is configured to be removably disposed in the pocket of the vest portion 12. The upper head section 60 of the inner support layer 58 is configured to be disposed outside of the pocket of the vest portion 12. In the illustrative embodiment, when the inner support layer 58 is initially inserted into the pocket of the vest portion 12, the entire inner support layer 58 is inserted through the pocket opening 48, and then the "wings" of the upper head section 60 of the inner support layer 58 pop out through the head opening 56 of the vest portion 12 due to the flexible nature of the material forming the inner support layer 58. In the illustrative embodiment, the upper head section 60 of the generally T-shaped inner support layer 58 forms a semi-rigid hood support when the T-shaped inner support layer 58 is inserted into the pocket of the vest portion 12.

In the illustrative embodiment, the inner support layer 58 of the head and neck support portion 34 may be formed from a suitable polymeric material or plastic. For example, the inner support layer 58 may be formed from polyethylene or another type of plastic that is semi-rigid, while still being capable of some flex for the insertion of the inner support layer 58 into the pocket of the vest portion 12, and the flexing of the upper head section 60 as it emerges through the head opening 56 of the vest portion 12.

Figure 3:
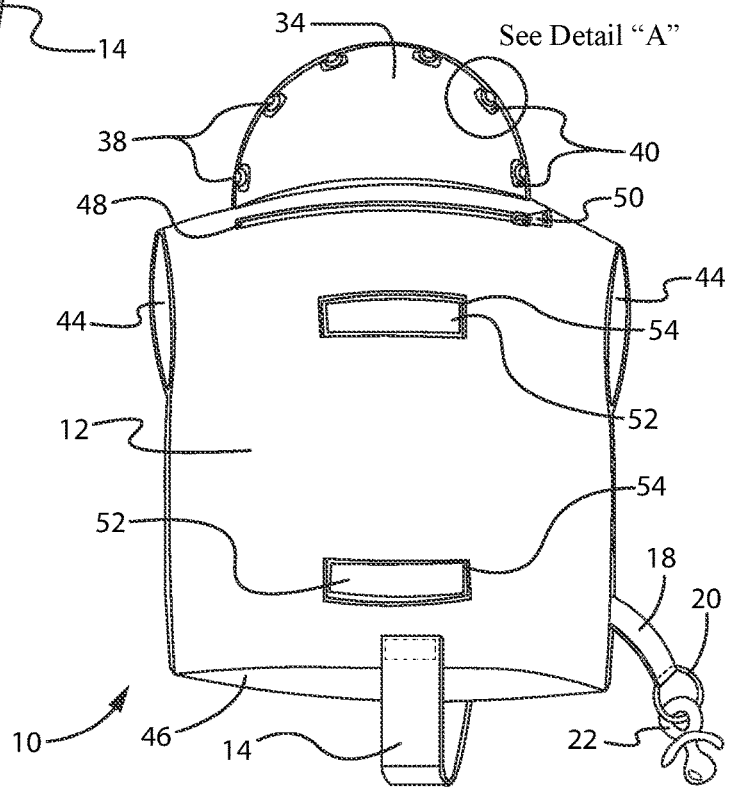
FIG. 3 is a rear elevational view of the baby vest neck support device of FIG. 1.
Figure 4:
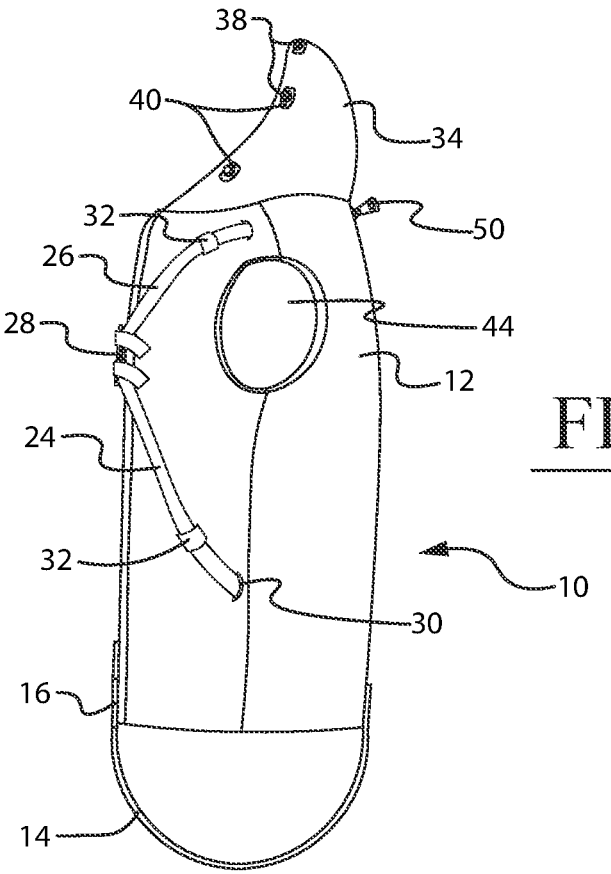
FIG. 4 is a first side view of the baby vest neck support device of FIG. 1.
Figure 5:
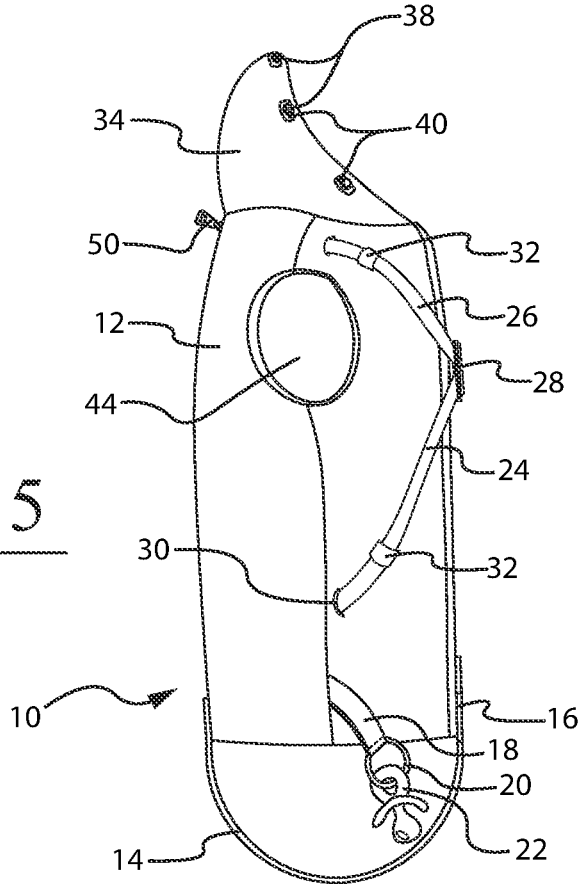
FIG. 5 is a second side view of the baby vest neck support device of FIG. 1.
Figure 6:
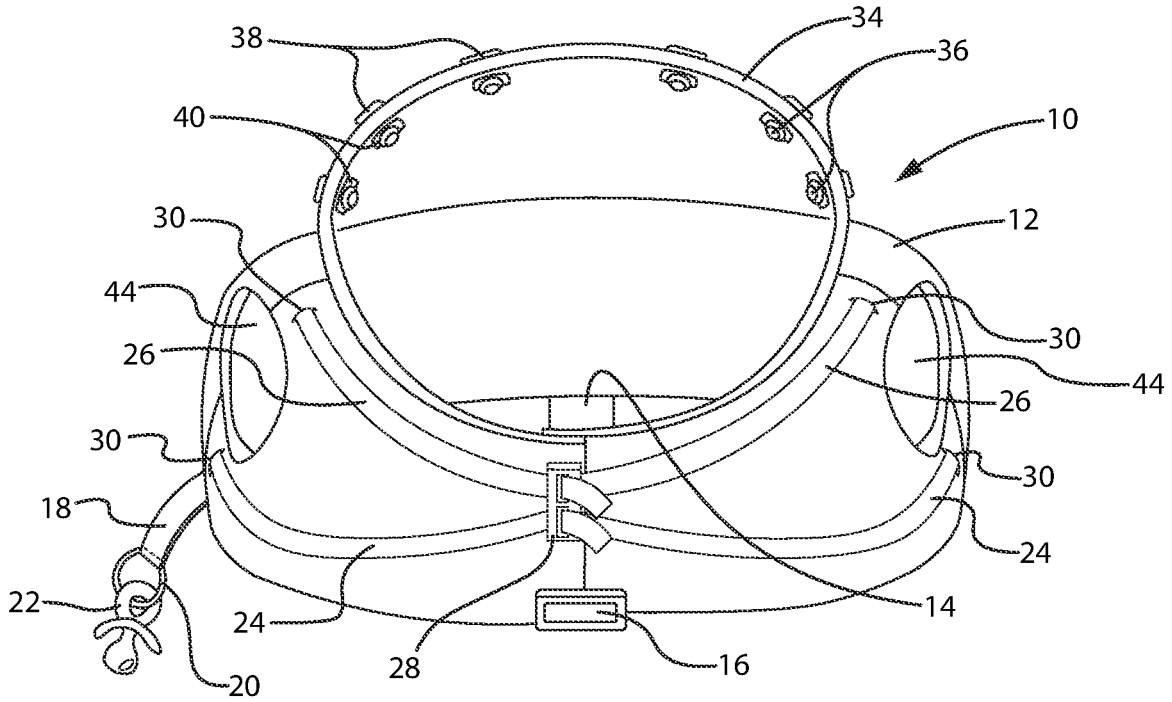
FIG. 6 is a top plan view of the baby vest neck support device of FIG. 1.
Figure 7:
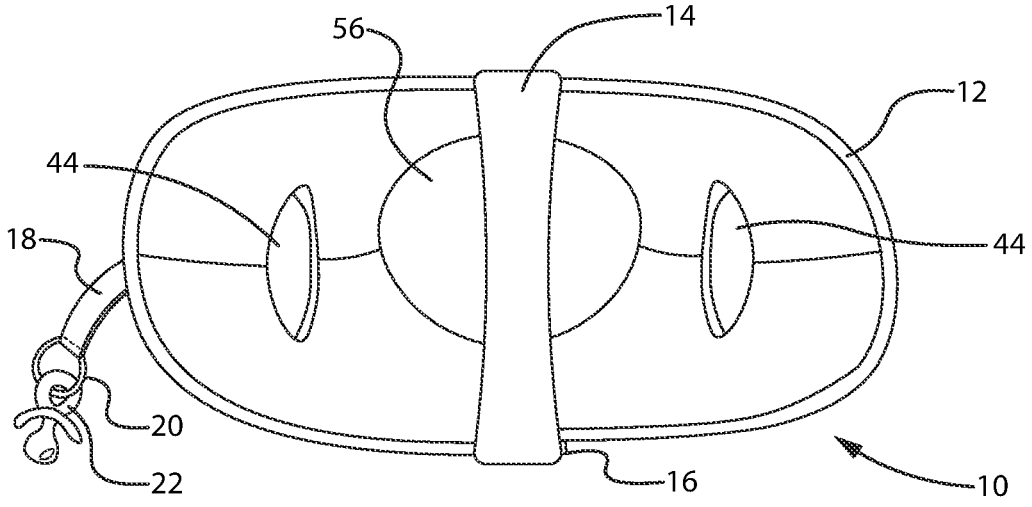
FIG. 7 is a bottom plan view of the baby vest neck support device of FIG. 1.

In addition, as shown in the illustrative embodiment of FIGS. 3 and 8, the vest portion 12 comprises a first pair of rectangular apertures 54 disposed in a rear surface of the vest portion 12, and the inner support layer 58 of the head and neck support portion 34 comprises a second pair of rectangular apertures 52 disposed in the lower torso portion 62 of the inner support layer 58. The first pair of rectangular apertures 54 of the vest portion 12 corresponds to the second pair of rectangular apertures 52 of the inner support layer 58 so as to receive respective securement straps with associated buckles for removably attaching the inner support layer 58 to the vest portion 12.

Figure 9:
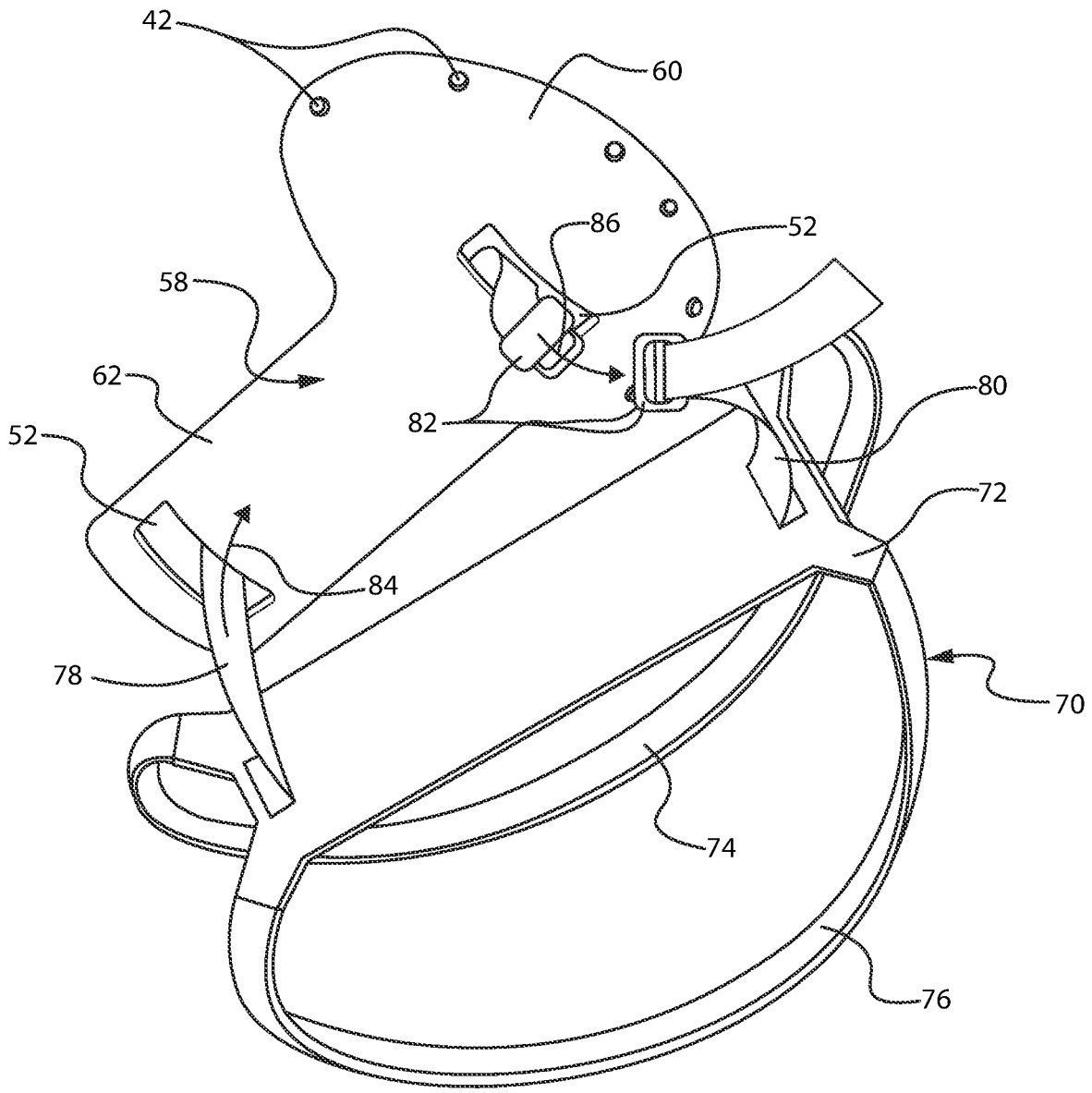
FIG. 9 is a perspective view of a backpack-type harness that may be used with the baby vest neck support device of FIG. 1, wherein the attachment of the backpack-type harness to the inner support layer is depicted.

In the illustrative embodiment, referring to FIG. 9, the baby vest neck support device 10 further comprises a backpack-type harness 70 for attaching the baby vest neck support device 10 to a torso of a person. As shown in FIG. 9, the backpack-type harness 70 comprises a base portion 72 that is configured to attach to the baby vest neck support device 10, and first and second shoulder straps 74, 76 that are configured to be disposed over the shoulders of a wearer (e.g., an adult parent carrying the baby 110 disposed in the device 10). In the illustrative embodiment, the backpack-type harness 70 is configured to be attached to the baby vest neck support device 10 by means of a connecting strap 78, 80 passing through the first pair of rectangular apertures 54 of the vest portion 12 and the second pair of rectangular apertures 52 of the inner support layer 58. As shown in FIG. 9, it can be seen that, after being looped through the apertures in the base portion 72 of the backpack-type harness 70 and the apertures 52, 54 in the device 10, the first connecting strap portion 78 is connected to the second connecting strap portion 80 by a buckle 82. In FIG. 9, the insertion of the first connecting strap portion 78 through one of the apertures 52 in the inner support layer 58 is diagrammatically represented by the curved arrow 84, while the connecting of the portions of the buckle 82 is diagrammatically represented by the curved arrow 86. Advantageously, the backpack-type harness 70 turns the baby vest neck support device 10 into a wearable piece of clothing that allows the parent to transport his or her baby using the device 10.

Figure 15:
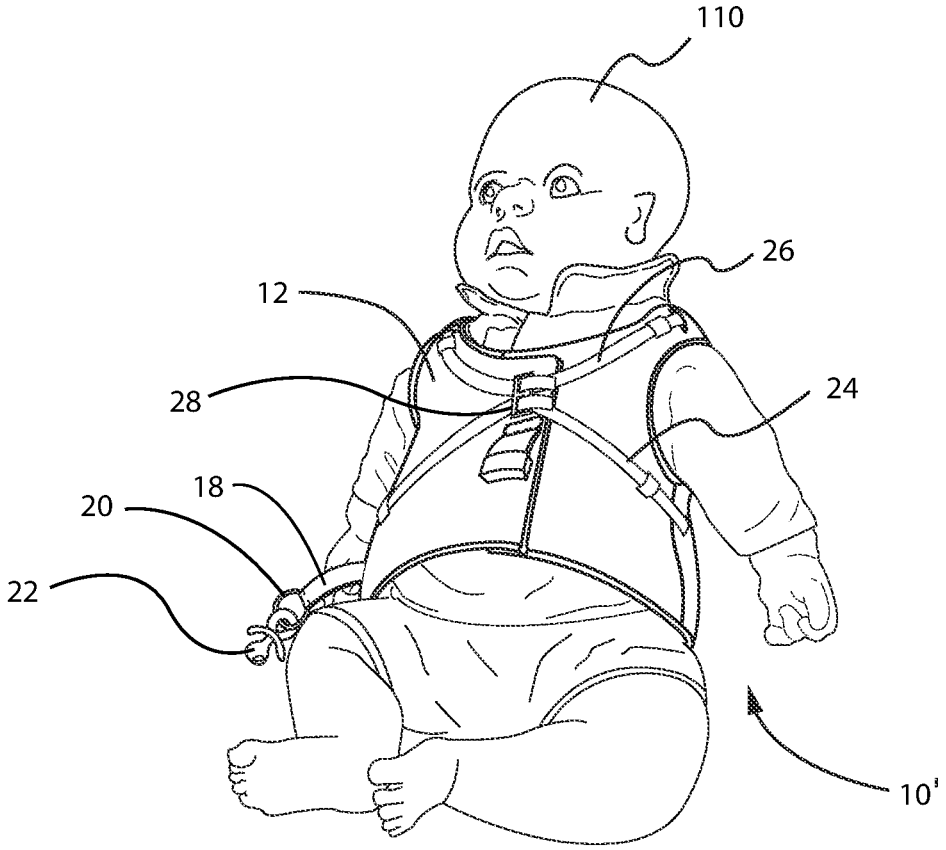
FIG. 15 is another perspective view of the baby vest neck support device of FIG. 1 disposed on a baby, wherein the hood portion of the baby vest neck support device has been removed.

As shown in the alternative embodiment of FIG. 15, if head and neck support is not needed, then the vest portion 12 of the device 10 may be used without the head and neck support portion 34 of the device 10. FIG. 15 illustrates the device 10' with the head and neck support portion 34 completely removed (e.g., refer to FIG. 8 for the manner in which the inner support layer 58 is removed from the vest portion 12). For example, if the baby 110 has strong enough neck muscles so that the head and neck brace is no longer needed, the device 10' is still useful as a vest without the head and neck support portion 34.

It is readily apparent that the aforedescribed baby vest neck support device 10 offers numerous advantages. First, the baby vest neck support device 10 provides support for a neck, head, spine, and spinal cord, and thus helps to eliminate injuries to a baby's neck, head, spine, and spinal cord. Secondly, the baby vest neck support device 10 prevents a newborn baby's neck from falling backward, therefore avoiding neck injuries and brain damage to the infant. New parents and non-experienced family members and friends are usually worried when holding a newborn and often struggle to hold them correctly. The device 10 described herein will help parents, whom often worry when their baby is being held and passed around by friends and family members, to feel more comfortable while others are holding or carrying their baby. Finally, the vest neck support device 10 provides head and neck support to people with cerebral palsy that do not have head and neck control. The device 10 is also able to provide back support to others with this condition. In addition, the device 10 could have a positive impact in helping to prevent acquired cerebral palsy caused by head and brain injuries by providing head and neck support to the baby.

Advantageously, the aforedescribed vest neck support device 10 provides neck, head, vertebral spine, and cervical support to individuals (e.g., babies and people with cerebral palsy). The vest neck support device 10 is not limited to use with babies, but rather can be used by any person (e.g., babies, people with cerebral palsy, Torticollis, etc.). The vest portion 12 can be adjusted to the size of the individual using the straps 14, 24, 26 provided on the vest portion 12. Also, the vest neck support device 10 can be made using different colors and material patterns to match personal preferences.

Any of the features, attributes, or steps of the above described embodiments and variations can be used in combination with any of the other features, attributes, and steps of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

REFERENCES

1) "Developmental milestones: head control" from Baby Centre UK Website
2) "What Are the Injuries When an Infant's Head Isn't Supported?" from Hello Motherhood Website
3) "Studies Implicate Early Injury to Cerebellum as Major Cause of Autism" from RSS Website
4) "Definition of Cerebral Palsy" from Cerebral Palsy Website.
5) "Cerebral Palsy: Hope Through Research" from National Institute of Neurological Disorders and Stroke Website

The invention claimed is:

1. A baby vest neck support device, comprising:

a vest portion, the vest portion defining a head opening for accommodating a head of a baby, arm openings for accommodating arms of the baby, and a torso opening for accommodating a torso of the baby, and the vest portion including one or more straps for securing the vest portion to the baby; and a head and neck support portion coupled to the vest portion, the head and neck support portion including an inner support layer configured to be partially received within a pocket of the vest portion, the inner support layer of the head and neck support portion being removable from the pocket of the vest portion, the pocket of the vest portion including a pocket opening with a closure mechanism disposed transversely across a rear surface of the vest portion, the head and neck support portion further including an outer padded layer disposed over an upper head section of the inner support layer; wherein the outer padded layer and the upper head section constitute an upper head support of the head and neck support portion;

wherein the vest portion comprises one or more first apertures disposed in a rear surface of the vest portion, the inner support layer of the head and neck support portion comprises one or more second apertures disposed in a rear surface of the inner support layer, and the one or more first apertures of the vest portion corresponding to the one or more second apertures of the inner support layer so as to receive one or more portions of a connecting strap for removably attaching the inner support layer to the vest portion.

2. The baby vest neck support device according to claim 1, wherein the one or more straps of the vest portion comprise at least one torso strap configured to be disposed around the torso of the baby and a crotch strap configured to be disposed in a crotch area of the baby.

3. The baby vest neck support device according to claim 1, wherein the closure mechanism of the pocket of the vest portion comprises a zipper closure mechanism.

4. The baby vest neck support device according to claim 1, wherein a lower torso section of the inner support layer of the head and neck support portion is configured to be removably disposed in the pocket of the vest portion, and wherein the upper head section of the inner support layer is configured to be disposed outside of the pocket of the vest portion.

5. The baby vest neck support device according to claim 1, further comprising a backpack-type harness for attaching the baby vest neck support device to a torso of a person, the backpack-type harness configured to be attached to the baby vest neck support device by means of the one or more portions of the connecting strap passing through the one or more first apertures of the vest portion and the one or more second apertures of the inner support layer.

6. The baby vest neck support device according to claim 1, wherein the outer padded layer of the upper head support forms a pocket for receiving the upper head section of the inner support layer.

7. A baby vest neck support device, comprising:

a vest portion, the vest portion defining a head opening for accommodating a head of a baby, arm openings for accommodating arms of the baby, and a torso opening for accommodating a torso of the baby, and the vest portion including one or more straps for securing the vest portion to the baby; and a head and neck support portion coupled to the vest portion, the head and neck support portion including an inner support layer configured to be partially received within a pocket of the vest portion, the inner support layer of the head and neck support portion being removable from the pocket of the vest portion, the pocket of the vest portion including a pocket opening with a closure mechanism disposed transversely across a rear surface of the vest portion, the head and neck support portion further including an outer padded layer disposed over an upper head section of the inner support layer, wherein the outer padded layer and the upper head section constitute an upper head support of the head and neck support portion, the upper head support of the head and neck support portion being in the form of a hood, and the hood of the head and neck support portion including at least one plurality of attachment devices for attaching at least one accessory to the hood of the head and neck support portion;

wherein the vest portion comprises one or more first apertures disposed in a rear surface of the vest portion, the inner support layer of the head and neck support portion comprises one or more second apertures disposed in a rear surface of the inner support layer, and the one or more first apertures of the vest portion corresponding to the one or more second apertures of the inner support layer so as to receive one or more portions of a connecting strap for removably attaching the inner support layer to the vest portion.

8. The baby vest neck support device according to claim 7, wherein the one or more straps of the vest portion comprise at least one torso strap configured to be disposed around the torso of the baby and a crotch strap configured to be disposed in a crotch area of the baby.

9. The baby vest neck support device according to claim 7, wherein the at least one accessory comprises an interior accessory and/or an exterior accessory, and wherein the at least one plurality of attachment devices of the hood of the head and neck support portion comprises a first plurality of the attachment portions on an interior of the hood of the head and neck support portion for attaching the interior accessory to the hood, and a second plurality of the attachment portions on an exterior of the hood of the head and neck support portion for attaching the exterior accessory to the hood.

10. The baby vest neck support device according to claim 9, wherein the interior accessory to the hood comprises a pillow, and wherein the exterior accessory to the hood is selected from the group consisting of a head stabilizer accessory, a hanging toy ring, a blanket, and combinations thereof.

11. The baby vest neck support device according to claim 7, wherein the closure mechanism of the pocket of the vest portion comprises a zipper closure mechanism.

12. The baby vest neck support device according to claim 7, wherein the inner support layer of the head and neck support portion comprises a lower torso section that is configured to be removably disposed in the pocket of the vest portion, and wherein the upper head section of the inner support layer is configured to be disposed outside of the pocket of the vest portion.

13. The baby vest neck support device according to claim 7, further comprising a backpack-type harness for attaching the baby vest neck support device to a torso of a person, the backpack-type harness configured to be attached to the baby vest neck support device by means of the one or more portions of the connecting strap passing through the one or more first apertures of the vest portion and the one or more second apertures of the inner support layer.

* * * * *